US009107464B2

(12) United States Patent
Tom et al.

(10) Patent No.: US 9,107,464 B2
(45) Date of Patent: Aug. 18, 2015

(54) QUICK RELEASE DEVICE FOR SAFETY HELMET

(71) Applicant: No Limit Safety, LLC, Pittsburg, KS (US)

(72) Inventors: Darnell Tom, Wellsville, KS (US); Nathan Sanko, Kansas City, MO (US)

(73) Assignee: No Limit Safety, LLC, Pittsburg, KS (US)

( * ) Notice: Subject to any disclaimer, the term of this patent is extended or adjusted under 35 U.S.C. 154(b) by 280 days.

(21) Appl. No.: 13/633,380

(22) Filed: Oct. 2, 2012

(65) Prior Publication Data

US 2014/0090156 A1 Apr. 3, 2014

(51) Int. Cl.
*A44B 1/04* (2006.01)
*A42B 3/04* (2006.01)

(52) U.S. Cl.
CPC ..... *A42B 3/0473* (2013.01); *Y10T 24/3424* (2015.01)

(58) Field of Classification Search
CPC ..... A44B 17/0017; A44B 17/0011; A44B 17/0005; A44B 17/00; A44B 17/0023; A44B 17/0041; A44B 17/0064; A44B 17/0076; A44B 17/007; A44B 17/0088; A44B 17/0094; A44B 17/0047; A44B 17/0052; F16B 21/165; F16B 2/16; B25B 31/005
USPC ..... 24/324, 107, 108, 114.4, 114.05, 604, 24/674; 411/348
See application file for complete search history.

(56) References Cited

U.S. PATENT DOCUMENTS

| | | | | |
|---|---|---|---|---|
| 2,749,588 | A * | 6/1956 | Pliszczak et al. | 24/104 |
| 2,869,202 | A * | 1/1959 | Buckingham | 24/110 |
| 3,793,685 | A * | 2/1974 | Knecht | 24/651 |
| 4,144,794 | A * | 3/1979 | Silverman et al. | 84/327 |
| 4,198,080 | A * | 4/1980 | Carpenter | 285/277 |
| 4,638,510 | A | 1/1987 | Hubbard | |
| 4,643,472 | A * | 2/1987 | Schukei et al. | 294/94 |
| 5,333,329 | A | 8/1994 | Hong | |
| 6,009,566 | A | 1/2000 | Hubbard | |
| 6,047,621 | A | 4/2000 | Dries et al. | |
| 2004/0216206 | A1 | 11/2004 | Schroth | |
| 2007/0087612 | A1 * | 4/2007 | Tsujita | 439/346 |
| 2007/0240291 | A1 | 10/2007 | Downing et al. | |
| 2009/0241304 | A1 * | 10/2009 | Halstead et al. | 24/594.1 |
| 2010/0011548 | A1 | 1/2010 | Rudduck et al. | |

OTHER PUBLICATIONS

International Search Report and Written Opinion; Mailing Date: Dec. 23, 2013; International Application No. PCT/US2013/059754; International Filing Date: Sep. 12, 2013.

* cited by examiner

*Primary Examiner* — Victor Batson
*Assistant Examiner* — Matthew Sullivan
(74) *Attorney, Agent, or Firm* — Hovey Williams LLP

(57) ABSTRACT

A quick release device comprises an anchor to couple to a safety helmet and a latch to couple to a tether. The anchor may include a cylindrical wall with an indentation circumferentially located thereon. The latch is configured to be attached to and removed from the anchor and may include a barrel, a plurality of ball bearings, and a push-pull button. The barrel may include a sidewall in which the ball bearings are rigidly retained when the latch is in a locked state and the ball bearings are loosely retained when the latch is in a released state. The push-pull button may cover one end of the barrel and may be pushed to attached the latch to the anchor and pulled to remove the latch from the anchor.

17 Claims, 8 Drawing Sheets

QUICK RELEASE DEVICE FOR SAFETY HELMET

BACKGROUND OF THE INVENTION

1. Field of the Invention

Embodiments of the current invention relate to automobile racing safety equipment. More particularly, embodiments of the current invention relate to a quick release device for attaching a tether to a safety helmet.

2. Description of the Related Art

A head and neck support (HANS) device is a structure that is worn around the neck and over the shoulders of a race car driver while racing. The driver's helmet is connected to the HANS device with a tether in order to reduce the likelihood or severity of head and/or neck injuries in the event of a crash or collision. The tethering of the helmet to the HANS device generally prevents extended forward motion of the helmet (and head) relative to the HANS device. The tether may slidably couple to the rear of a collar portion of the HANS device and generally allows the driver to rotate his head from side to side. The tether may include an elongated flat strap with two latches—one latch secured at each end of the tether. Each latch connects to an anchor on the helmet.

Typically, the latch includes a pair of elongated, spaced apart rails. The rails have a circular or oval space between them at a proximal end of the latch and are parallel to one another and joined together at a distal end. The diameter of the circular space is generally greater than the distance between the rails in the parallel portion. The anchor typically includes a cylindrical or oval stud positioned on top of a post at the base of the anchor. The stud is of greater diameter than the post. The latch is attached to the anchor by placing the circular or oval space on the stud and aligning it with the post. The latch is then pulled or slid parallel to the surface of the helmet until the distal end of the latch contacts the post. The latch cannot be pulled away from the surface of the helmet because the surface normal motion of the rails is blocked by the stud of the anchor. The latch may be removed from the anchor by pushing or sliding it parallel to the surface of the helmet until the proximal end contacts the post and the circular or oval space may slide over the stud.

This type of latch and anchor may be difficult for the driver to utilize because typically the driver is already wearing a helmet and gloves when attempting to tether the helmet to the HANS device. Attaching the latch to the anchor is challenging because the driver has to align the circular or oval space of the latch with the stud. Furthermore, the latch may rotate while it is attached to the anchor without the driver being aware of the direction to which the latch has turned. As a result, each time the driver tries to remove the latch, he may have to slide it in a different direction in order to remove it. Thus, this type of latch and anchor may present problems to the driver both when attaching the latch and when removing it.

SUMMARY OF THE INVENTION

Embodiments of the current invention solve the above-mentioned problems by providing a quick release device for attaching a tether to a safety helmet. An embodiment of the device broadly comprises an anchor to couple to the helmet and a latch to couple to the tether. The anchor may include a cylindrical wall with a circumferential indentation. The latch is configured to be attached to and removed from the anchor and may include a barrel, a plurality of ball bearings, and a push-pull button. The barrel may include a sidewall in which the ball bearings are rigidly retained when the latch is in a locked state and the ball bearings are loosely retained when the latch is in a released state. The push-pull button may cover one end of the barrel and may be pushed to attached the latch to the anchor and pulled to remove the latch from the anchor. The quick release device provides an advantage over prior art devices because all the driver has to do is roughly align the latch on the anchor and then press the latch to attach it to the anchor. Thus, a driver can quickly connect the device even when he is wearing gloves.

Another embodiment of the invention may broadly comprise a helmet and a tether to attach the helmet to a HANS device. The helmet may include a first anchor attached to a left rear side of the helmet and a second anchor attached to a right rear side of the helmet. The tether may couple to the HANS device and a may include a first latch coupled to one end and a second latch coupled to the other end. The first latch may attach to the first anchor and the second latch may attach to the second anchor by pushing the latches onto the anchors with a force normal to the surface of the helmet. The first latch may be removed from the first anchor and the second latch may be removed from the second anchor by pulling the latches from the anchors with a force normal to the surface of the helmet. Each anchor and each latch may further include features as described above.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figures 1, 2, 3:
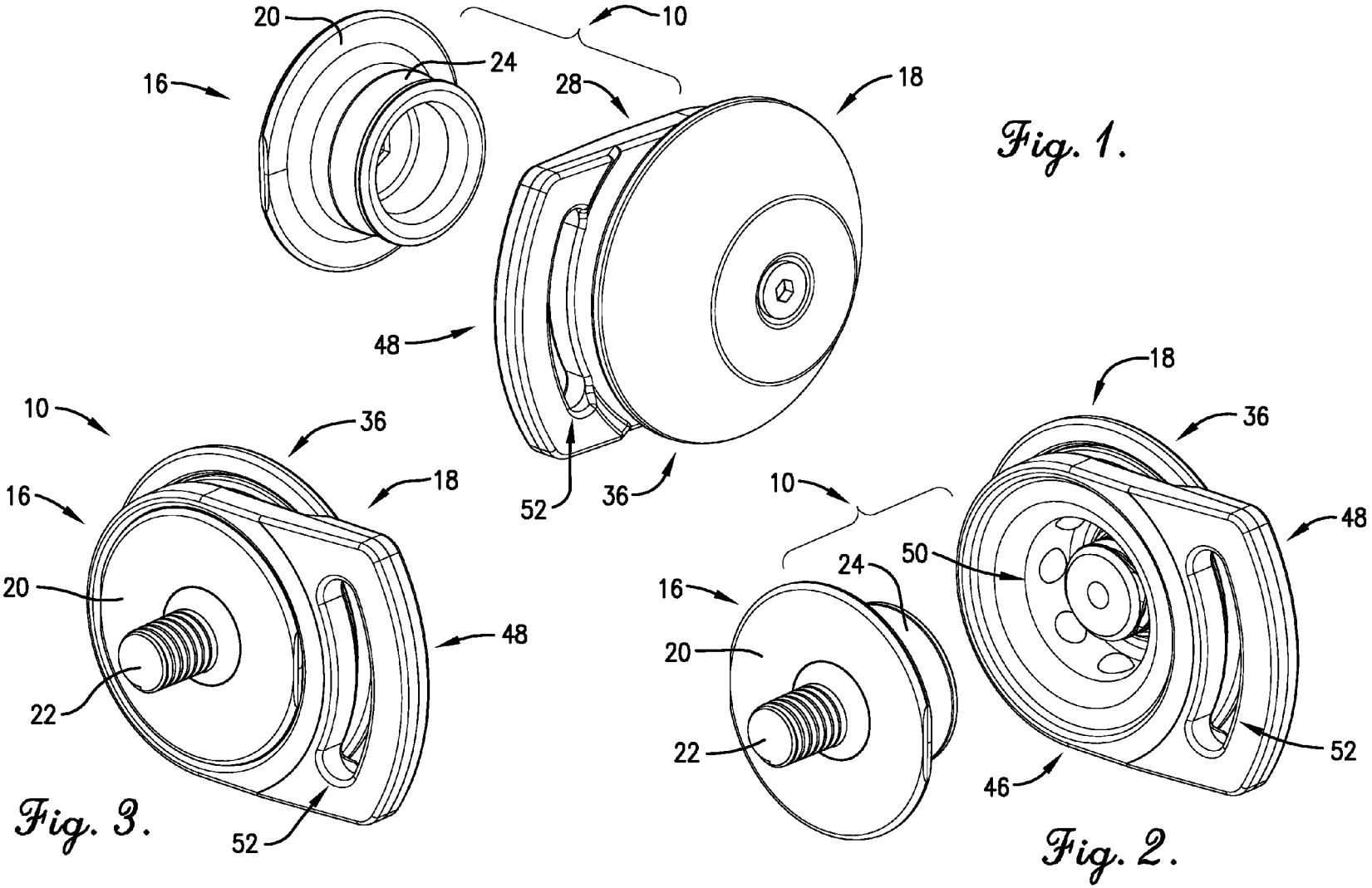
FIG. 1 is a front perspective view of a quick release device, constructed in accordance with various embodiments of the current invention, depicting an anchor and a latch separated from one another.
FIG. 2 is a rear perspective view of the device.
FIG. 3 is a rear perspective view of the device with the latch attached to the anchor.
Figure 4:
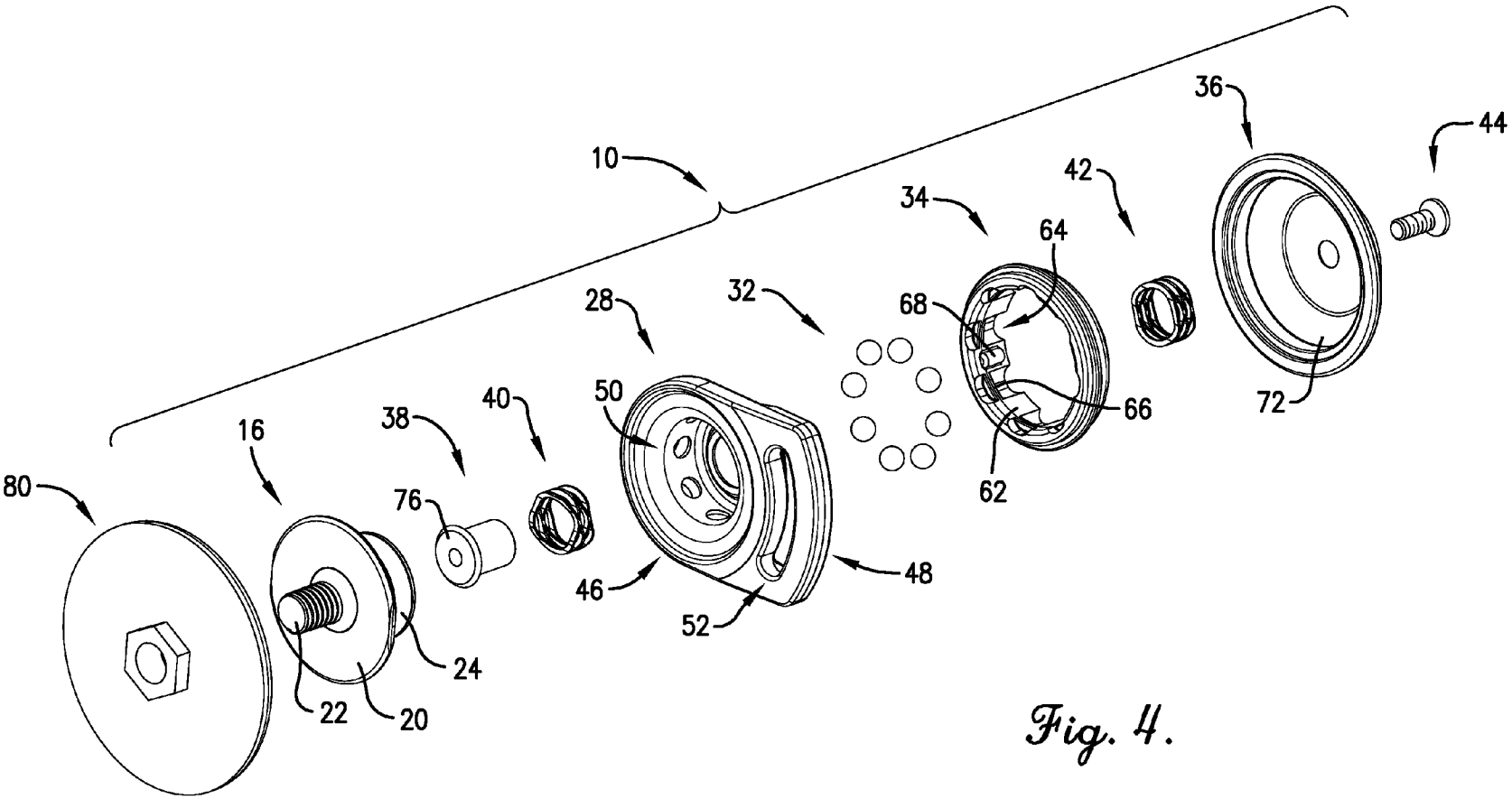
FIG. 4 is an exploded rear perspective view of the device.
Figure 5:
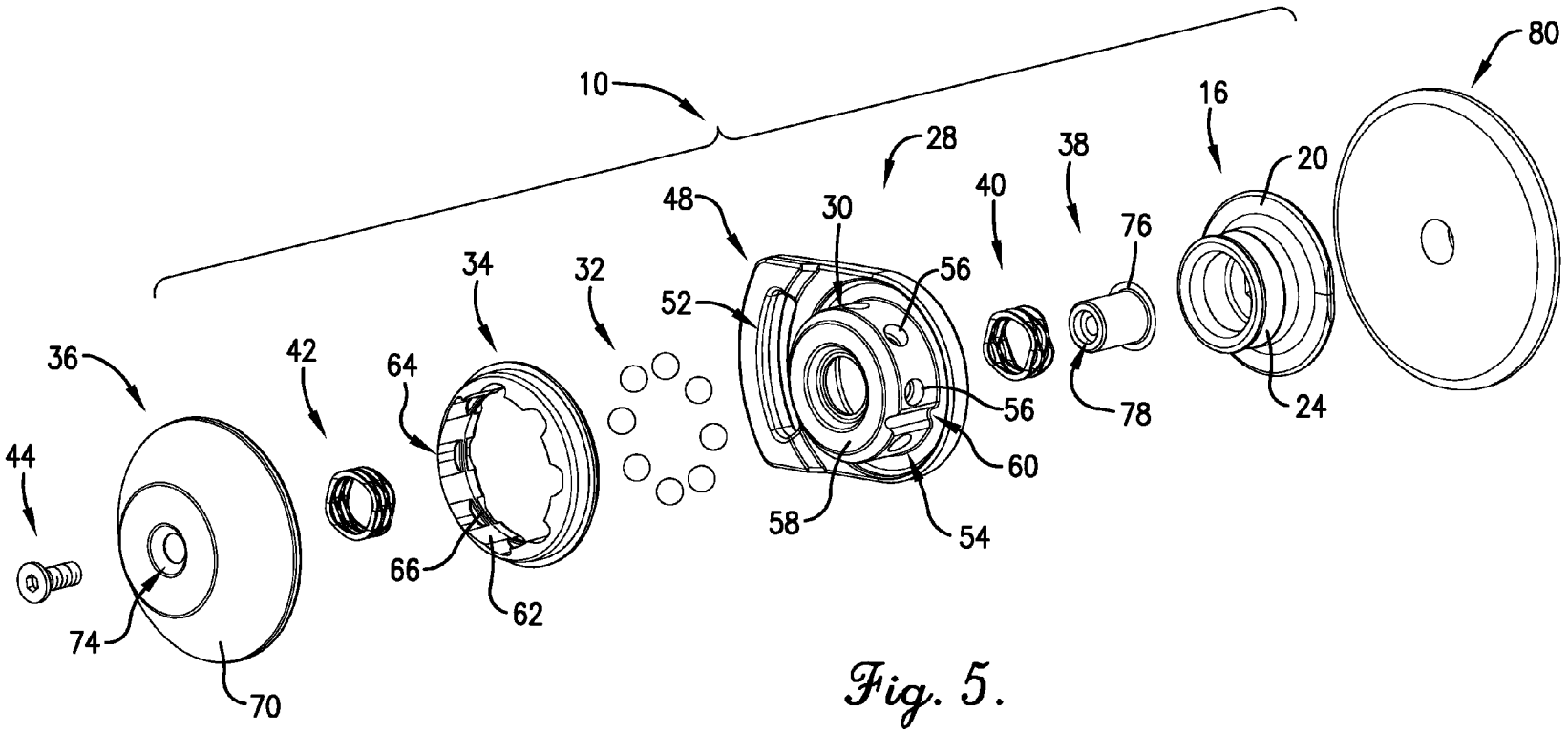
FIG. 5 is an exploded front perspective view of the device.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 10:
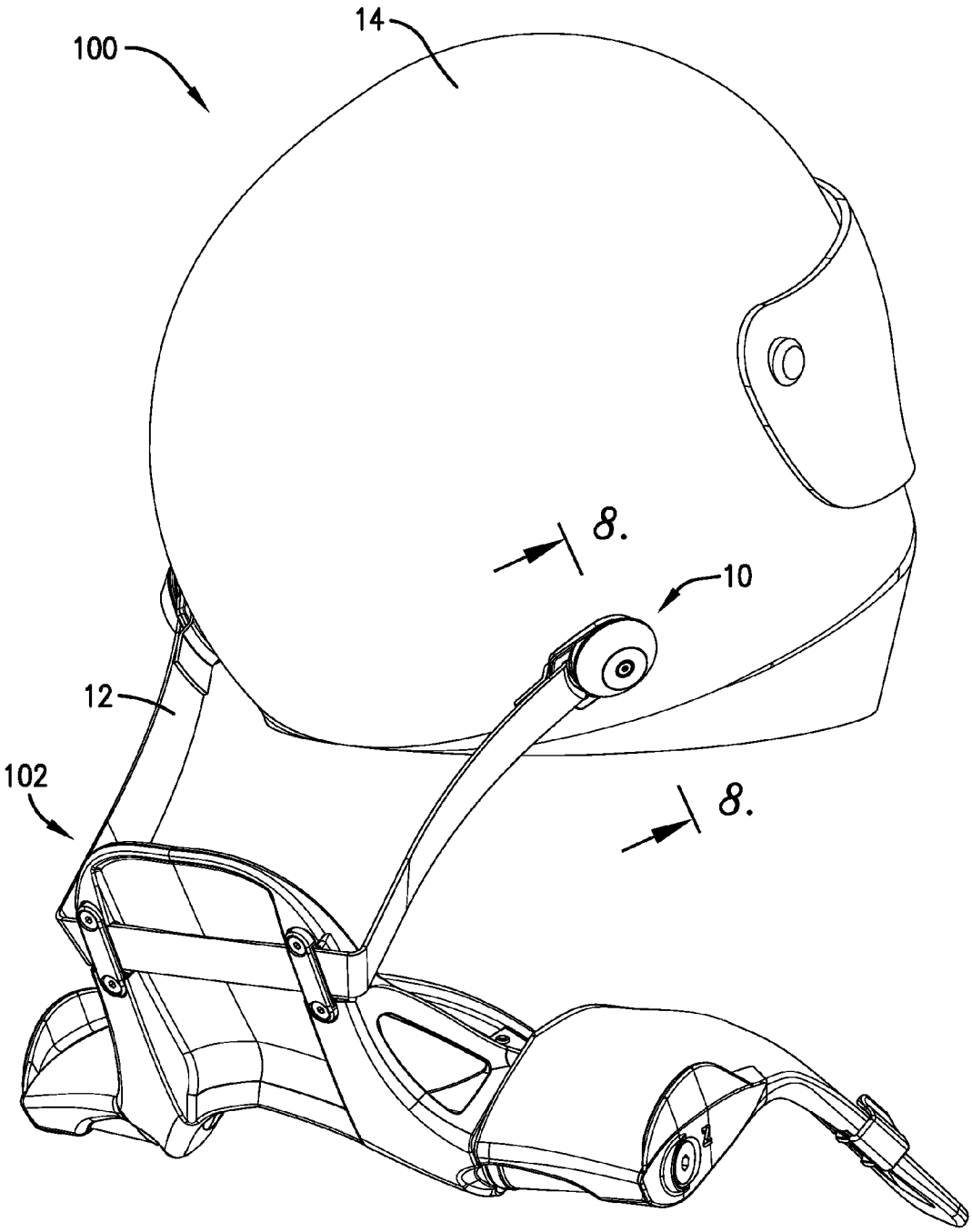
FIG. 10 is a rear perspective view of a safety helmet shown connected to a HANS device with a tether and the quick release device of FIGS. 1-8.
Figure 11:
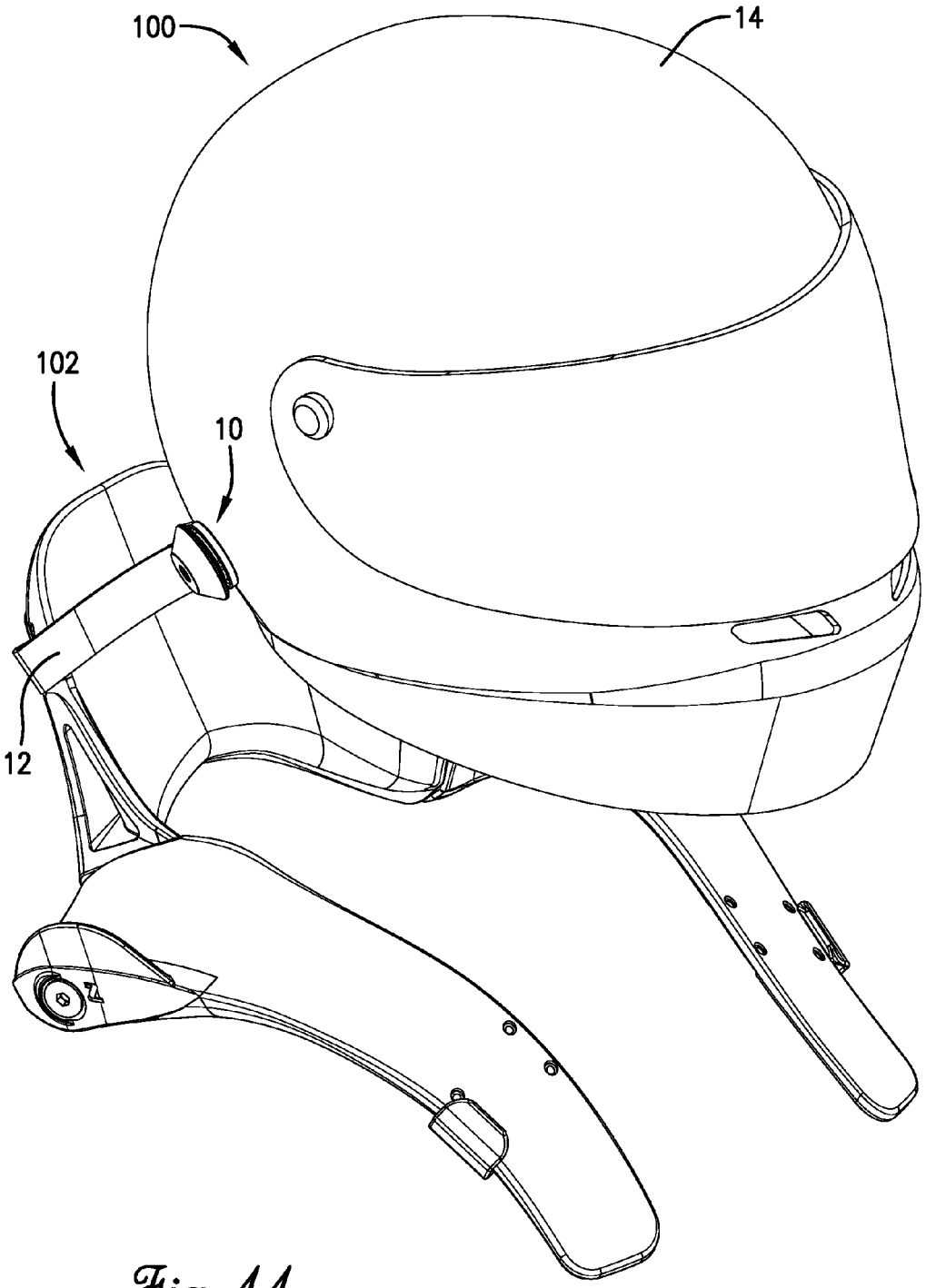
FIG. 11 is a front perspective view of the safety helmet, the HANS device, the tether, and the quick release device.

A quick release device 10 constructed in accordance with various embodiments of the current invention is shown in FIGS. 1-9. The quick release device 10 is designed for use with a tether 12 to connect a racing safety helmet 14 to a HANS device and may broadly comprise an anchor 16 and a latch 18. The anchor 16 is generally rigidly fixed to the helmet 14, and the latch 18 is coupled to the tether 12, as shown in FIGS. 10-11. In use, the latch 18 is attached to the anchor 16 to secure the safety helmet 14 to the HANS device and removed from the anchor 16 to allow the driver to remove the helmet 14.

Referring to FIGS. 1-9, the anchor 16 may comprise an anchor base 20, a stud 22, and a cylindrical wall 24. The anchor base 20 may be generally flat, relatively thin, and generally circular with an upper surface and an opposing lower surface. The stud 22 is rigidly attached to the lower surface of the anchor base 20 and may be of cylindrical shape and smaller diameter than the anchor base 20. Typically, the stud 22 is threaded in order to attach to the helmet 14. The cylindrical wall 24 is rigidly attached to the upper surface of the anchor base 20 and may include an inner surface with a slight inward taper. The cylindrical wall 24 may also include an outer surface with an indentation 26 that has an arcuate cross-sectional shape. The indentation 26 may be configured to receive a ball bearing or the like. In various embodiments, the anchor base 20, the stud 22, and the cylindrical wall 24 may be integrally or monolithically formed as a unit.

The latch 18 may comprise a latch base 28, a barrel 30, a plurality of ball bearings 32, a castle ring 34, a push-pull button 36, a spring guide 38, a first spring 40, a second spring 42, and a fastener 44.

The latch base 28 may be generally flat with a circular portion 46 and a tab 48 coupled thereto. The circular portion 46 may include a central opening 50, while the tab 48 may include a tether opening 52 shaped to retain the tether 12. The latch base 28 may further include an upper surface and an opposing lower surface.

The barrel 30 may be generally cylindrical with a sidewall 54 and a plurality of passthroughs 56 or openings distributed along the circumference thereof. Each passthrough 56 may be sized and shaped to retain a ball bearing 32 and may include a taper such that a portion of the ball bearing 32 may protrude into the center of the barrel 30 while still being retained in the passthrough 56. In an exemplary barrel 30, there are eight passthroughs 56. The barrel 30 may also include an inner flange 58 at an upper end of the sidewall 54 that extends inward toward the center of the barrel 30. The barrel 30 may be rigidly attached to the upper surface of the latch base 28 at the circular portion 46 such that the center of the barrel 30 is aligned with the central opening 50. In various embodiments, the barrel 30 and the latch base 28 may be integrally or monolithically formed as a unit. In some embodiments, the barrel 30 may further include an alignment notch 60 that is axially oriented on the exterior of the sidewall 54 positioned between two adjacent passthroughs 56.

The ball bearings 32 may be standard ball bearings as are known in the art and may be positioned within the passthroughs 56 of the barrel 30, such that one ball bearing 32 is in each passthrough 56. In an exemplary device 10, there are eight ball bearings 32.

The castle ring 34 may be annular with an inner surface 62 and an outer surface. The inner surface 62 may include a plurality of grooves 64 or scallops that are axially aligned and distributed along the inner surface 62. The grooves 64 may also align with the passthroughs 56 of the barrel 30 and the ball bearings 32, such that one groove 64 may align with each passthrough 56 and ball bearing 32. The castle ring 34 may also include a band 66 positioned along the inner surface 62, wherein the band 66 has the same diameter as the inner surface 62 and extends through the grooves 64. The castle ring 34 is generally positioned around the barrel 30 with the inner surface 62 of the castle ring 34 in contact with the outer surface of the sidewall 54 of the barrel 30.

Figure 6:
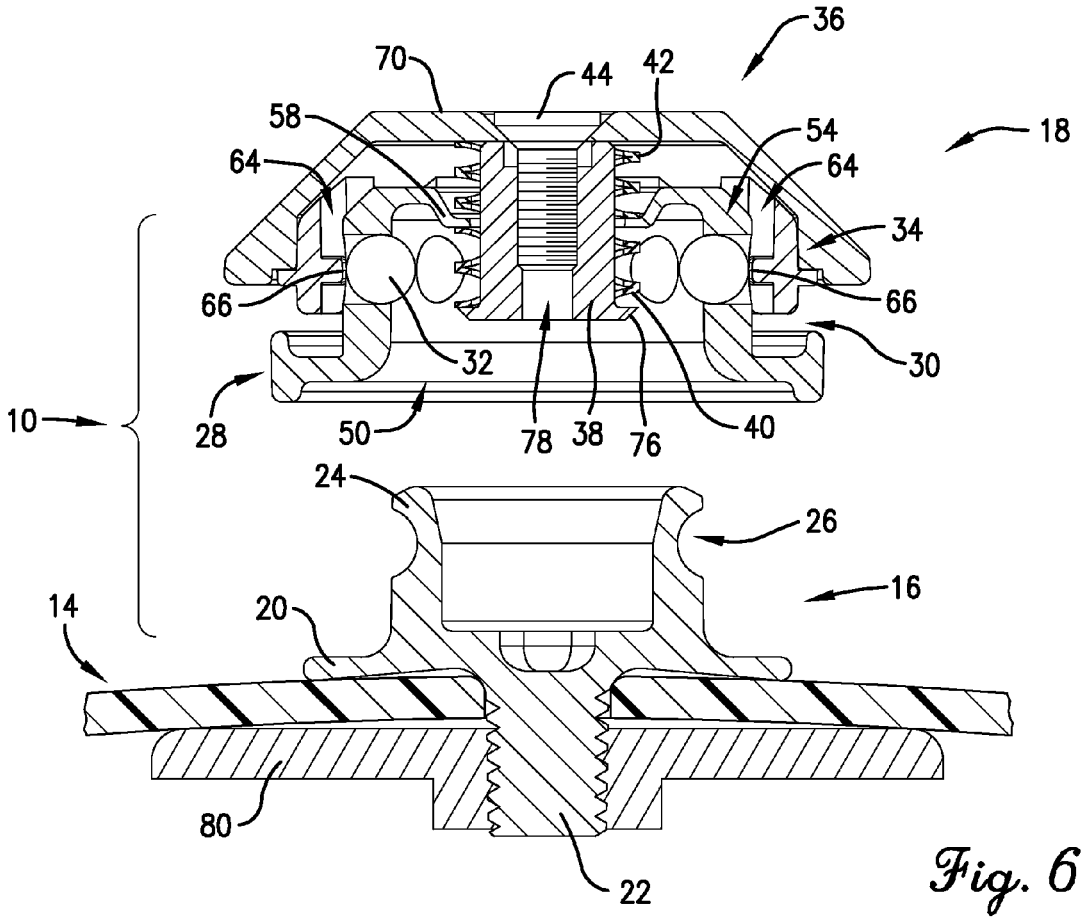
FIG. 6 is a side sectional view of the device with the latch separated from the anchor.
Figure 7:
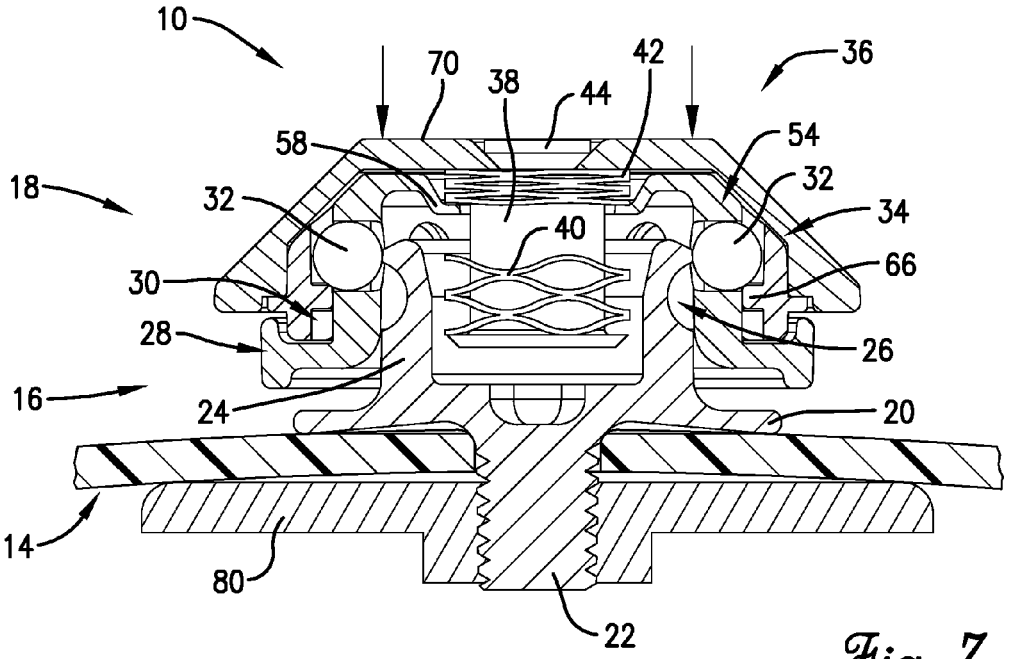
FIG. 7 is a side sectional view of the device just before the latch is attached to the anchor.
Figure 8:
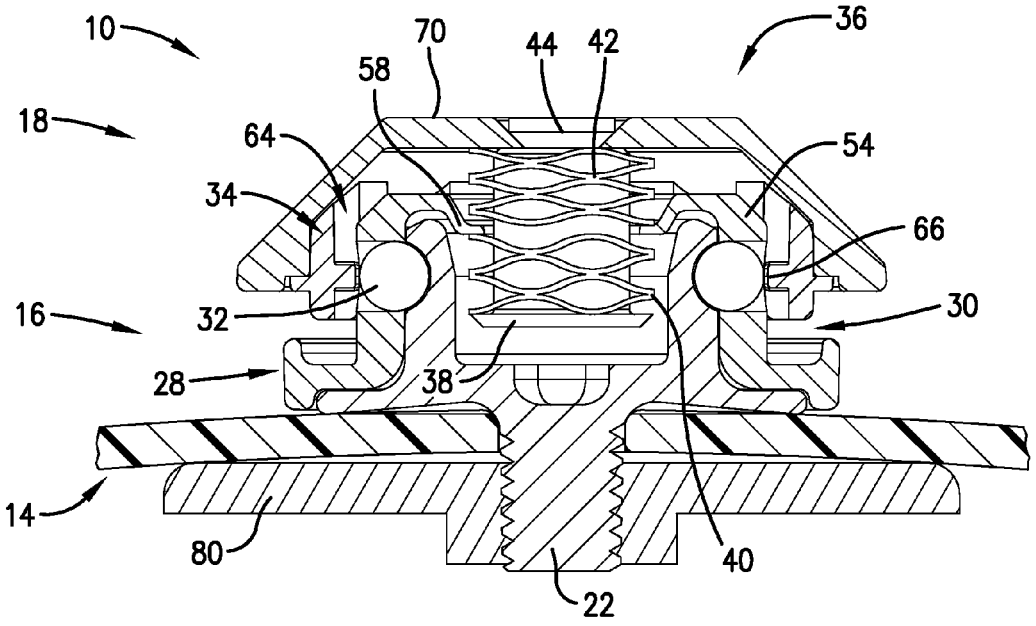
FIG. 8 is a side sectional view of the device with the latch attached to the anchor.
Figure 9:
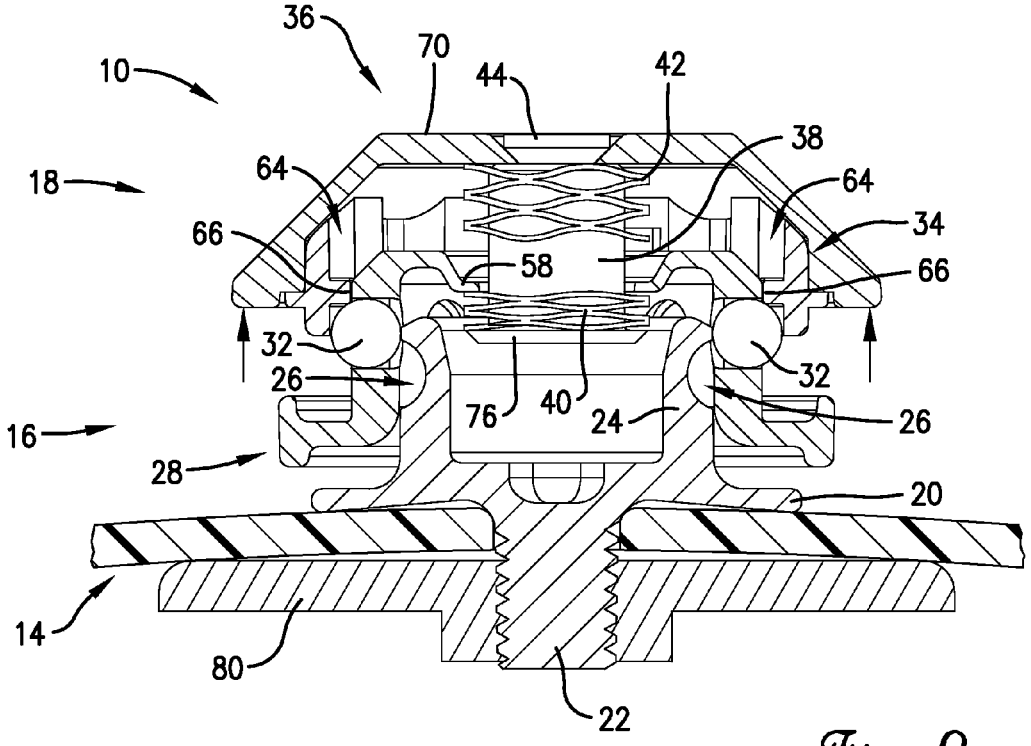
FIG. 9 is a side sectional view of the device just after the latch is removed from the anchor.

Referring to FIGS. 6-9, the castle ring 34 may move up and down, or axially, with respect to the barrel 30. When the castle ring 34 is in a central position in the axial direction, as seen in FIGS. 6 and 8, the band 66 may contact the ball bearings 32 to prevent their movement and hold them rigidly within the passthroughs 56 in a position where the ball bearings 32 protrude into the center of the barrel 30. When the castle ring 34 moves either up or down from the central position, as seen in FIGS. 7 and 9, the band 66 no longer prevents movement of the ball bearings 32 and they are loosely held within the passthroughs 56 such that they may move away from the center of the barrel 30. In some embodiments, the castle ring 34 may further include an alignment lug 68 protruding from the inner surface 62 positioned between two adjacent grooves 64. When the device 10 is assembled, the alignment lug 68 may be positioned within the alignment notch 60 of the barrel 30 in order to prevent the castle ring 34 from rotating with respect to the barrel 30.

The push-pull button 36 generally has a frustoconical shape with a planar upper surface 70 and a hollow interior with an internal surface 72. The push-pull button 36 may also include a central opening 74 in the upper surface 70.

The spring guide 38 may be generally cylindrical with an outer flange 76 extending outward along a circumference at one end of the spring guide 38. The spring guide 38 may include a central opening 78 with a threaded interior wall. The spring guide 38 may generally retain the first spring 40 and the second spring 42.

The first spring 40 may include resilient or elastomeric members such as coil springs, compression springs, rubber rings or washers, or the like. An exemplary first spring 40, as shown in the figures, is a multiwave compression spring. Generally, the first spring 40 has an annular or ring shape with an inner diameter that is greater than the outer diameter of the spring guide 38. The first spring 40 may be held or retained by the spring guide 38.

In some embodiments, the second spring 42 may be substantially identical to the first spring 40. In other embodiments, the second spring 42 may include one or more characteristics that are different from the first spring 40. For example, the second spring 42 may have a different height from the first spring 40. Or the second spring 42 may have a different spring constant or stiffness. However, in general, the second spring 42 has the same inner diameter as the first spring 40. And, the second spring 42 may be held or retained by the spring guide 38.

The fastener 44 may be a screw or similar threaded component. Generally, the fastener 44 has the same diameter and thread profile as the diameter of the central opening 78 of the spring guide 38.

The structure of the latch 18, with reference to FIGS. 4-9, may be as follows. The barrel 30 may be attached to or formed with the latch base 28. The ball bearings 32 may be positioned in the passthroughs 56. The castle ring 34 may be positioned on the barrel 30 such that the alignment lug 68 fits into the alignment notch 60. The second spring 42 may be positioned on the inner flange 58 of the barrel 30. The inner surface 62 of the push-pull button 36 may be coupled to the castle ring 34 and in contact with the second spring 42 such that the push-pull button 36 covers one end of the barrel 30. The first spring 40 may be positioned on the outer flange 76 of the spring guide 38, and the spring guide 38 may be positioned in the central opening 50 of the latch base 28 and in the center of the second spring 42. The central opening 78 of the spring guide 38 may be aligned with the central opening 74 of the push-pull button 36. The fastener 44 may be positioned in the central opening 78 of the spring guide 38 in order to attach the push-pull button 36 to the spring guide 38.

The latch 18 may have a locked state and a released state. The locked state may be the default state and occurs when the ball bearings 32 are rigidly retained by the sidewall 54 of the barrel 30 as a result of the band 66 of the castle ring 34 being aligned in the central position with the ball bearings 32 and preventing them from moving. The locked state also coincides with the first spring 40 and the second spring 42 being in an uncompressed rest state, since the first spring 40 and the second spring 42, when compressed, tend to urge the castle ring 34 into the central position.

The latch 18 may be placed in the released state by either pushing or pulling the push-pull button 36. Pushing, or downward pressure with a surface normal force as seen in FIG. 7, on the push-pull button 36 applies a compressive force on the first spring 40 in order to move the castle ring 34 downward with respect to the barrel 30. The band 66 of the castle ring 34 is also moved downward so that it no longer holds the ball bearings 32 in place, and thus, the ball bearings 32 may move within the passthroughs 56. In the released state, the latch 18 may be attached to or removed from the anchor 16. When the downward force is removed, the first spring 40 biases the castle ring 34 upward to the central position such that the band 66 once again holds the ball bearings 32 in place within the passthroughs 56 and the latch 18 is relocked. Alternatively, pulling, or upward pressure with a surface normal force as seen in FIG. 9, on the push-pull button 36 applies a compressive force on the second spring 42 in order to move the castle ring 34 upward with respect to the barrel 30. The band 66 of the castle ring 34 is also moved upward so that it no longer holds the ball bearings 32 in place, thereby releasing the ball bearings 32. When the upward force is removed, the second spring 42 biases the castle ring 34 downward to the central position such that the band 66 once again holds the ball bearings 32 in place within the passthroughs 56 and the latch 18 is relocked.

The device 10 may operate as follows. The device 10 may have an attachment process and a removal process. During the attachment process, the latch 18 may be placed on the anchor 16 such that the inner surface of the barrel 30 surrounds the outer surface of the cylindrical wall 24 of the anchor 16. The ball bearings 32 touch the upper edge of the cylindrical wall 24. At this point, the latch 18 is still in a locked state. A pushing, or downward, force on the upper surface 70 of the push-pull button 36 releases the ball bearings 32, as discussed above, and the latch 18 may move downward such that the ball bearings 32 align with the indentation 26 on the cylindrical wall 24 of the anchor 16, as seen in FIG. 7. Removing the pushing force on the push-pull button 36 allows the castle ring 34 to rise and the band 66 to press the ball bearings 32 into the indentation 26 of the anchor 16, thereby fixedly attaching the latch 18 to the anchor 16, as seen in FIG. 8.

During the removal process, a pulling, or upward, force is applied to the push-pull button 36, typically by pulling the lower edge thereof, which releases the ball bearings 32, as discussed above. Thus, the ball bearings 32 recede from the indentation of the cylindrical wall 24 of the anchor 16, and the latch 18 may be pulled upward and removed from the anchor 16, as seen in FIG. 9. As soon as the ball bearings 32 are clear from the cylindrical wall 24, the first spring 40 biases the castle ring 34 downward so that the latch 18 is relocked.

With reference to FIGS. 6-11, the device 10 may be used with a safety helmet 14 to form a system 100 as follows. A first anchor 16 may be attached to the helmet 14 on the left side toward the rear thereof. The helmet 14 may have a threaded opening to which the stud 22 of the first anchor 16 is attached. If not, then the anchor 16 may include a threaded disc 80 that is placed on the interior of the helmet 14, as seen in FIGS. 6-9. A hole may be drilled in the helmet 14 through which the stud 22 may be placed and the anchor may be attached to the threaded disc 80. In the same fashion, a second anchor 16 may be attached to the helmet 14 on the right side toward the rear thereof.

A first latch 18 may be coupled to one end of a tether 12 such that a portion of the tether 12 is looped through the tether opening 52 of the latch base 28. A second latch 18 may be coupled to the other end of the tether 12 in the same fashion. The tether 12 may be slidably coupled to a collar portion of a HANS device 102, as shown in FIGS. 10-11.

While wearing the HANS device 102 on his shoulders and the helmet 14 on his head, the driver may attach the first latch 18 to the first anchor 16 by placing the latch 18 over the anchor 16 and pushing on the push-pull button 36 with a force normal to the surface of the helmet 14, as described above. The driver may attach the second latch 18 to the second anchor 16 in the same fashion. Typically, the driver is wearing gloves at the same time he is trying to attach the tether 12 to the helmet 14. Since the circular central opening 50 of the latch 18 naturally fits on the cylindrical wall 24 of the anchor 16, all the driver has to do is roughly align the latch 18 on the anchor 16. Then, by simply pushing on the push-pull button 36, the latch 18 is attached to the anchor 16. Thus, the device 10 has the ability to self locate and quickly connect even when the driver is wearing gloves.

When the driver is ready to take off his helmet 14, he may remove the first latch 18 from the first anchor 16 by pulling the push-pull button 36 with a force normal to the surface of the helmet 14, usually at the lower edge of the push-pull button 36, as described above. The driver may remove the second latch 18 from the second anchor 16 in the same fashion.

Figure 13:
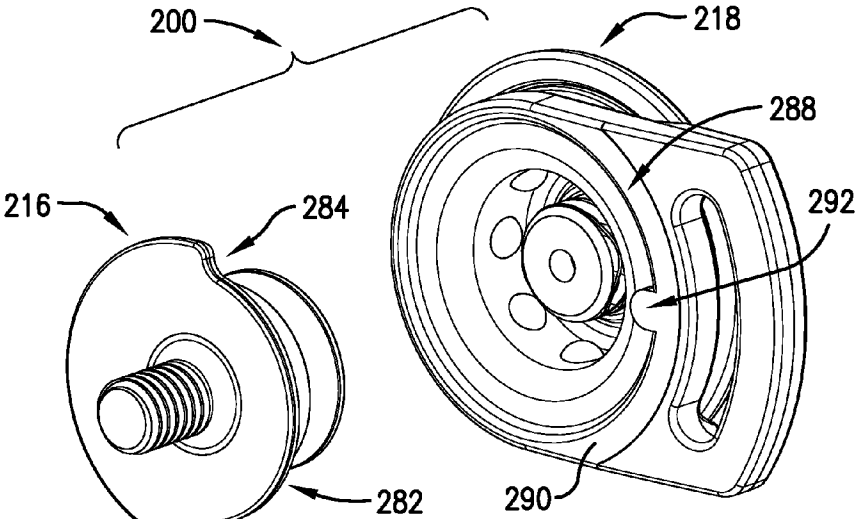
FIG. 13 is a rear perspective view of the alternative embodiment of the device.
Figure 12:
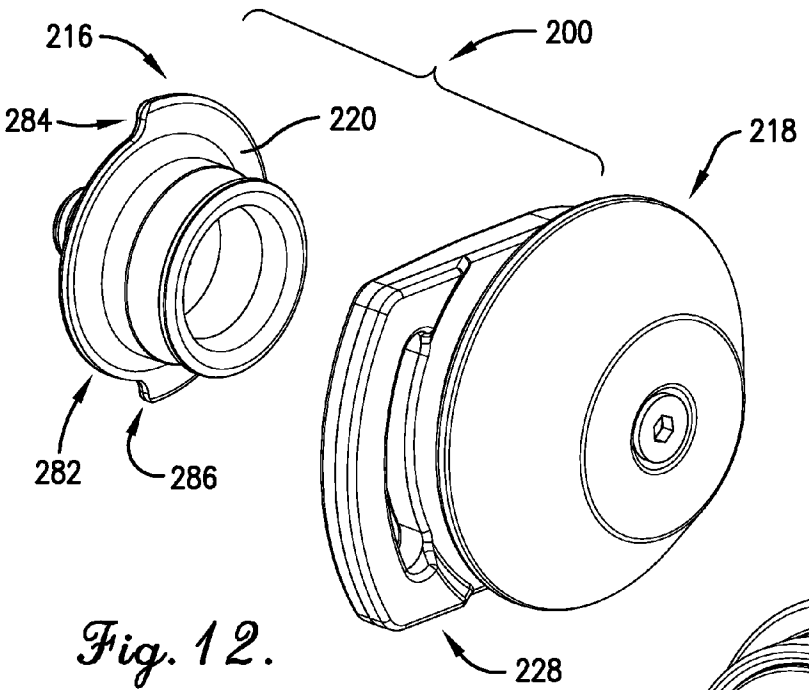
FIG. 12 is a front perspective view of a quick release device constructed in accordance with an alternative embodiment of the invention and depicting an anchor and a latch, wherein rotation of the latch with respect to the anchor is limited.
Figure 14:
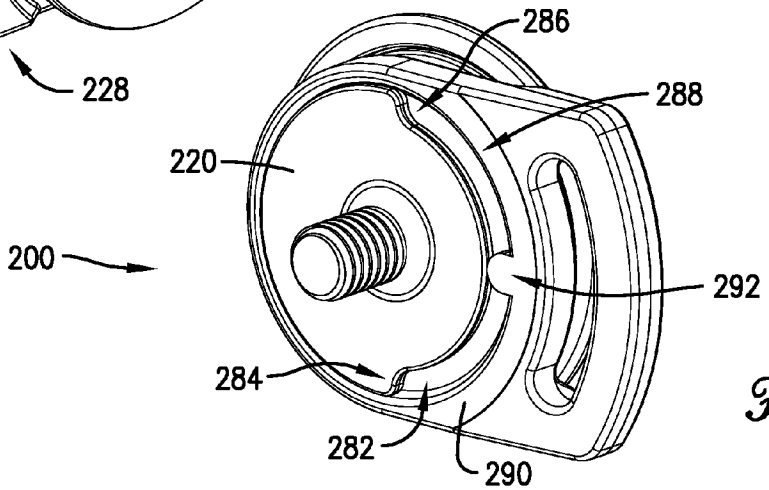
FIG. 14 is a rear perspective view of the alternative embodiment of the device with the latch attached to the anchor.

A quick release device 200 constructed in accordance with an alternative embodiment of the current invention is shown in FIGS. 12-14 and provides a rotation limiting architecture of an anchor 216 and a latch 218 that limits the rotation of the latch 218 with respect to the anchor 216. The anchor 216 and the latch 218 are substantially similar to the anchor 16 and the latch 18, respectively, with the following exceptions.

The anchor 216 may include an anchor base 220 that has a roughly circular shape wherein a first portion of the anchor base 220 has a first circumference with a first radius. The anchor base 220 may include a cutout 282 wherein a second portion of the anchor base 220 has a second circumference with a second radius. The second radius is smaller than the first radius. In an exemplary embodiment, the angle occupied by the cutout 282 is approximately 180°, although this angle may vary. The anchor base 220 may further include a first ridge 284 and a second ridge 286, located at opposing edges of the cutout 282 where the radius tapers gradually from the first radius to the second radius.

The latch 218 may include a latch base 228 with a roughly circular recess 288 on a lower surface 290 wherein the recess has a radius that is slightly larger than the first radius of the anchor base 220. The latch base 228 may also include a lug 292 of relatively narrow width that protrudes inward toward the center of the recess 288. The lug 292 may be of smaller radius than the recess 288.

The latch 218 functions in a substantially identical manner to the latch 18. Furthermore, the attachment process and removal process of the device 200 are substantially identical to the attachment and removal processes of the device 10, with the following exception. When the latch 218 is to be attached to the anchor 216, the latch 218 must be oriented such that the lug 292 of the latch base 228 aligns with the cutout 282 of the anchor base 220. Once the latch 218 is attached to the anchor 216, the anchor base 220 is positioned inside the recess 288 of the latch base 228. If the latch 218 is rotated with respect to the anchor 216, the rotation is limited by the lug 292 of the latch base 228 encountering either the first ridge 284 or the second ridge 286 (depending on the direction of rotation) of the anchor base 220. The amount of rotation that is possible is determined by the circumference of the cutout 282 and the width of the lug 292. For example, a smaller circumference leads to a smaller amount of rotation, while a larger circumference leads to greater rotation. In addition, a wider lug 292 leads to a smaller amount of rotation, while a more narrow lug 292 leads to greater rotation.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A quick release device comprising:

an anchor including a cylindrical wall with a circumferential indentation; and a latch configured to be attached to and removed from the anchor, the latch including:

a base;

a barrel with a sidewall extending from the base and having at least one ball bearing passthrough;

at least one ball bearing retained in the at least one ball bearing passthrough of the sidewall;

a push-pull button covering one end of the barrel; and a ring positioned in the push-pull button, the ring having an inner surface comprising:

one or more grooves; and a band extending annularly through the one or more grooves so as to divide each of the one or more grooves into a proximal portion and a distal portion, wherein the proximal portion of the one or more grooves becomes aligned with the at least one ball bearing passthrough so that the anchor can urge the at least one ball bearing at least partially into the proximal portion of the one or more grooves when the push-pull button is pushed towards the base to a push-attach position for attaching the latch to the anchor;

the distal portion of the one or more grooves becoming aligned with the at least one ball bearing passthrough so that the anchor can urge the at least one ball bearing at least partially into the distal portion of the one or more grooves when the push-pull button is pulled away from the base to a pull-release position for removing the latch from the anchor; and the band urging the at least one ball bearing into the circumferential indentation of the cylindrical sidewall of the anchor when the latch is attached to the anchor and the push-pull button is in a neutral position.

2. The quick release device of claim 1, wherein the barrel of the latch further comprises an inwardly extending flange positioned near a distal end of the barrel, the push-pull button further comprising a spring guide extending past the inwardly extending flange of the barrel of the latch and having a distal outwardly extending flange, and the latch further comprising a first spring and a second spring, the first spring being positioned between the inwardly extending flange of the barrel and the push-pull button and axially aligned with the barrel for exerting a biasing force on the inwardly extending flange and the push-pull button and urging the push-pull button out of the push-attach position, the second spring being positioned between the outwardly extending flange of the spring guide and the inwardly extending flange of the barrel for exerting an opposite biasing force on the inwardly extending flange and the outwardly extending flange of the spring guide and urging the push-pull button out of the pull-release position.

3. The quick release device of claim 2, wherein the first and second springs have substantially the same spring constants.

4. The quick release device of claim 2, wherein the first and second springs are sized and shaped to cooperatively urge the push-pull button to the neutral position such that the band of the ring is aligned with the at least one ball-bearing passthrough when the push-pull button is neither pushed nor pulled.

5. The quick release device of claim 2, wherein the spring guide is substantially cylindrical and extends through the first spring and the second spring so as to keep the first spring and the second spring axially aligned with the barrel and each other.

6. The quick release device of claim 2, wherein the first spring and the second spring are multiwave compression springs.

7. The quick release device of claim 1, wherein the ring further comprises an alignment lug and the barrel further comprises an alignment notch for receiving the alignment lug therein and preventing the ring from rotating with respect to the barrel.

8. The quick release device of claim 1, wherein the at least one ball bearing passthrough comprises eight equally spaced ball bearing passthroughs, the at least one ball bearing comprising eight ball bearings, and the one or more grooves comprising eight equally spaced grooves.

9. The quick release device of claim 1, wherein the at least one ball bearing passthrough comprises a taper such that a portion of the at least one ball bearing may protrude into a center of the barrel while still being retained in the at least one ball bearing passthrough.

10. A quick release device comprising:

an anchor including a cylindrical wall with a circumferential indentation; and a latch configured to be attached to and removed from the anchor, the latch including:

a barrel with a sidewall;

at least one ball bearing retained in the sidewall; and a push-pull button covering one end of the barrel and comprising:

one or more grooves having a proximal portion and a distal portion separated from the proximal portion; and a band positioned in the one or more grooves between the proximal portion and the distal portion, wherein the latch has a released state and a locked state and the latch is placed in the released state when the push-pull button is pushed from the locked state and when the push-pull button is pulled from the locked state;

the band of the push-pull button rigidly retaining the at least one ball bearing in the sidewall when the latch is in the locked state;

the proximal portion of the one or more grooves being aligned with the at least one ball bearing for at least partially receiving the at least one ball bearing in the proximal portion when the latch is in the released state and the push-pull button is pushed; and the distal portion of the one or more grooves being aligned with the at least one ball bearing for at least partially receiving the at least one ball bearing in the distal portion when the latch is in the released state and the push-pull button is pulled.

11. The quick release device of claim 10, wherein the push-pull button is pushed to attached the latch to the anchor and the push-pull button is pulled to remove the latch from the anchor.

12. The quick release device of claim 10, wherein the at least one ball bearing is received in the indentation when the latch is attached to the anchor.

13. The quick release device of claim 10, further comprising a first spring configured to bias the latch from the released state to the latched state when the push-pull button is pulled.

14. The quick release device of claim 13, wherein the first spring is positioned on a spring guide located along a central axis of the barrel and on a distal side of an inward flange at one end of the barrel opposing the push-pull button.

15. The quick release device of claim 10, further comprising a second spring configured to bias the latch from the released state to the latched state when the push-pull button is pushed.

16. The quick release device of claim 15, wherein the second spring is positioned on a spring guide located along a central axis of the barrel and on a proximal side of an inward flange at one end of the barrel between the push-pull button and the inward flange.

17. The quick release device of claim 10, wherein the anchor includes a circular anchor base of a first radius with a cutout of a smaller radius and the latch includes a latch base with a circular recess that includes an inward protruding lug such that when the latch is attached to the anchor the anchor base fits within the recess and the travel of the lug within the cutout limits the rotation of the latch with respect to the anchor.

* * * * *